US007528647B2

(12) United States Patent
Kawagoe

(10) Patent No.: US 7,528,647 B2
(45) Date of Patent: May 5, 2009

(54) SEMICONDUCTOR INTEGRATED CIRCUIT WHICH GENERATES DIFFERENT VOLTAGES BASED ON AN EXTERNAL POWER SUPPLY VOLTAGE AND A GENERATING METHOD OF THE DIFFERENT VOLTAGES

(75) Inventor: Masakuni Kawagoe, Miyazaki (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 54 days.

(21) Appl. No.: 11/199,240

(22) Filed: Aug. 9, 2005

(65) Prior Publication Data

US 2006/0087366 A1 Apr. 27, 2006

(30) Foreign Application Priority Data

Oct. 21, 2004 (JP) ..... 2004-307333

(51) Int. Cl.
*G05F 1/10* (2006.01)

(52) U.S. Cl. ..... 327/536; 363/60

(58) Field of Classification Search ..... 327/530, 327/536–538, 540–543; 363/59–60
See application file for complete search history.

(56) References Cited

U.S. PATENT DOCUMENTS 5,461,557 A * 10/1995 Tamagawa ..... 363/60
5,463,542 A * 10/1995 Okamoto ..... 363/60
5,483,486 A * 1/1996 Javanifard et al. ..... 365/185.17
6,028,374 A * 2/2000 Razak ..... 307/130
6,133,777 A * 10/2000 Savelli ..... 327/410
6,150,879 A * 11/2000 Watanabe ..... 327/589
6,151,229 A * 11/2000 Taub et al. ..... 363/60
6,246,280 B1 * 6/2001 Morishita ..... 327/535
6,333,864 B1 * 12/2001 Nishimura et al. ..... 363/78
6,462,725 B1 * 10/2002 Orisaka ..... 345/98
6,492,863 B2 * 12/2002 Kono et al. ..... 327/538
6,522,193 B2 * 2/2003 Shin ..... 327/536
6,812,776 B2 * 11/2004 Henry ..... 327/536
6,906,577 B2 * 6/2005 Kim ..... 327/536
7,005,912 B2 * 2/2006 Nonaka ..... 327/536
7,138,853 B2 * 11/2006 Kim et al. ..... 327/536
7,253,798 B2 * 8/2007 Smeets ..... 345/94
2001/0017812 A1 * 8/2001 Morishita ..... 365/226

FOREIGN PATENT DOCUMENTS

JP 2003091268 3/2003

* cited by examiner

*Primary Examiner*—Donovan Lincoln
*Assistant Examiner*—Thomas J Hiltunen
(74) *Attorney, Agent, or Firm*—Volentine & Whitt, P.L.L.C.

(57) ABSTRACT

A semiconductor integrated circuit includes a first voltage generating circuit which generates a boosted voltage based on a first external power supply voltage. The boosted voltage is greater than the first external power supply voltage. The semiconductor integrated circuit further includes a second voltage generating circuit which generates first and second converted output voltages which are different than the boosted voltage and each other. The second voltage generating circuit generates the first converted output voltage based on the first external power supply voltage. The second voltage generating circuit generates the second converted output voltage based on the boosted voltage after the first converted output voltage is generated.

19 Claims, 7 Drawing Sheets

SEMICONDUCTOR INTEGRATED CIRCUIT WHICH GENERATES DIFFERENT VOLTAGES BASED ON AN EXTERNAL POWER SUPPLY VOLTAGE AND A GENERATING METHOD OF THE DIFFERENT VOLTAGES

BACKGROUND OF THE INVENTION

1. Field of the Invention

The present invention relates to a semiconductor integrated circuit and to a method of generating different voltages, and in particular, to a semiconductor integrated circuit which generates a boosted voltage and which generates a converted voltage based on the boosted voltage in order to activate a liquid crystal panel, and to a method of generating the boosted voltage and the converted voltage. This is a counterpart of and claims priority to Japanese Patent Application No. 2004-307333 filed on Oct. 21, 2004, which is herein incorporated by reference.

2. Description of the Related Art

FIG. 1 is a circuit block diagram for describing a semiconductor integrated circuit which generates different voltages in the related art. As shown in FIG. 1, the semiconductor integrated circuit of the related art includes a control circuit 610, a boost circuit 620 and a step-down circuit 630. The boost circuit 620 generates a boosted voltage VDD based on a first external power supply voltage VCC1 in accordance with a control signal which is generated from the control circuit 610 based on a second external power supply voltage VCC2. On the other hand, the step-down circuit 630 generates a step-down voltage VEE based only on the boosted voltage VDD which is output from the boost circuit 620. The above-described semiconductor integrated circuit is described in a Patent Document 1 (Japanese Patent Publication Laid-open No. 2003-91268).

However, since the step-down circuit 630 generates the step-down voltage VEE based only on the boosted voltage VDD which is output from the boost circuit 620, electrical charge in the boosted voltage VDD may be consumed. Therefore, the boosted voltage VDD may be decreased. On such an occasion, a plurality of parasitic bipolar transistors 710 and 720 may appear in a semiconductor substrate 600 on which the boost circuit 620 and the step-down circuit 630 are disposed as shown in FIG. 2.

FIG. 2 is a sectional view for describing the semiconductor substrate 600 in which the parasitic bipolar transistors 710 and 720 appear. As shown in FIG. 2, the semiconductor substrate has a P-type conductivity and further includes a PMOS transistor Tr1 which configures the boosted circuit 620, and an NMOS transistor Tr2 which configures the step-down circuit 630. The PMOS transistor Tr1 is disposed on an N-conductive type well which is arranged in the semiconductor substrate 600, and the NMOS transistor Tr2 is disposed on the semiconductor substrate 600. When the boosted voltage VDD is decreased, the parasitic bipolar transistors 710 and 720 appear between the PMOS transistor Tr1 of the boosted circuit 620 and the NMOS transistor Tr2 of the step-down circuit 630. That is, a collector current passes through the parasitic bipolar transistor 710, and then an electrical potential is increased in accordance with the collector current of the parasitic bipolar transistor 710. Therefore, the parasitic bipolar transistor 720 is turned ON. As a result, a thyristor configured with the parasitic bipolar transistors 710 and 720 is turned ON, and a latch-up phenomenon may appear between the PMOS transistor Tr1 of the boosted circuit 620 and the NMOS transistor Tr2 of the step-down circuit 630. In order to suppress the latch-up phenomenon in the semiconductor substrate 600, a diode may be coupled to an output terminal of the boosted circuit 620 outside the boosted circuit 620 and the step-down circuit 630. However, formation of the diode increases cost and further complicates the manufacturing processes.

SUMMARY OF THE INVENTION

According to an aspect of the present invention, for achieving the above-mentioned object, there is provided a semiconductor integrated circuit which includes a first electrical source terminal and a second electrical source terminal. The first electrical source terminal receives a first external power supply voltage. The second electrical source terminal receives a second external power supply voltage less than the first external power supply voltage. The semiconductor integrated circuit further includes a first voltage generating circuit which is coupled to the first electrical source terminal. The first voltage generating circuit generates a boosted voltage based on the first external power supply voltage. The boosted voltage is greater than the first external power supply voltage. The semiconductor integrated circuit still further includes a second voltage generating circuit which is coupled to the first electrical source terminal and the first voltage generating circuit. The second voltage generating circuit generates a first converted output voltage and a second converted output voltage that are different than the boosted voltage and different from each other. The second voltage generating circuit generates the first converted output voltage based on the first external power supply voltage. The second voltage generating circuit generates the second converted output voltage based on the boosted voltage after the first converted output voltage is generated.

According to another aspect of the present invention, for achieving the above-mentioned object, there is provided a generating method of different voltages. In the method, a boosted voltage is generated based on a first external power supply voltage which is greater than a second external power supply voltage. The boosted voltage is greater than the first external power supply voltage. A first converted output voltage is generated based on the first external power supply voltage. The first converted output voltage is different than the boosted voltage. After the first converted output voltage is generated, a second converted output voltage which is different than the first converted output voltage is generated based on the boosted voltage. The second converted output voltage is different than the boosted voltage.

The above and further aspects and novel features of the invention will more fully appear from the following detailed description, appended claims and the accompanying drawings.

DETAILED DESCRIPTION OF THE PREFERRED EMBODIMENTS

Embodiments of the present invention will be described hereinafter with references to the accompanying drawings. The drawings used for this description illustrate major characteristic parts of embodiments in order that the present invention will be easily understood. However, the invention is not limited by these drawings.

Figure 1:
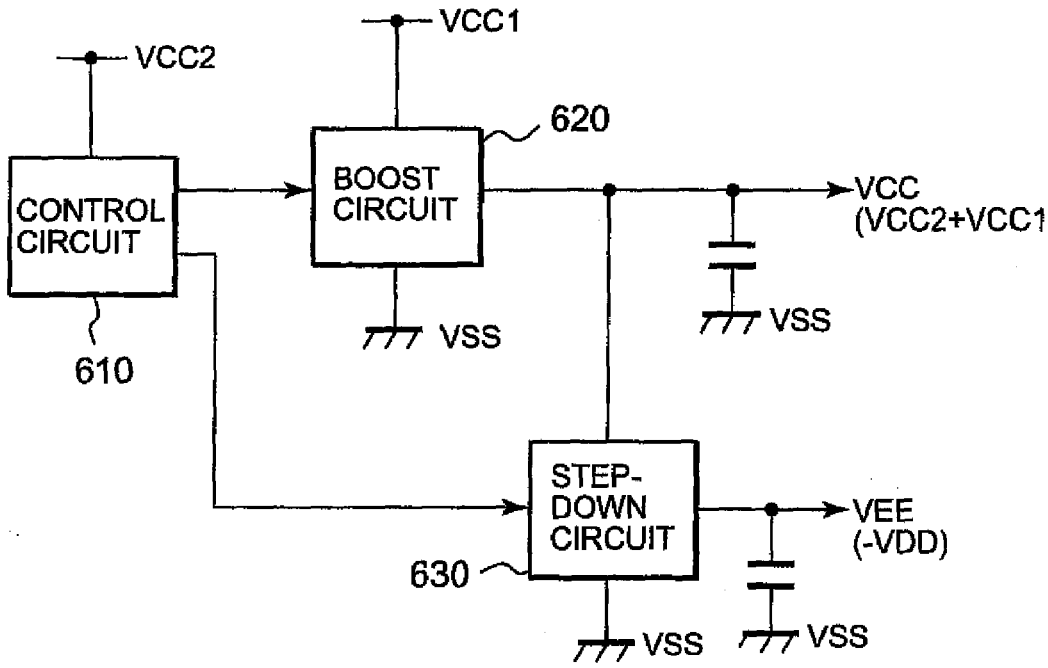
FIG. 1 PRIOR ART
FIG. 1 is a circuit block diagram for describing a semiconductor integrated circuit which generates different voltages in the related art.
Figure 2:
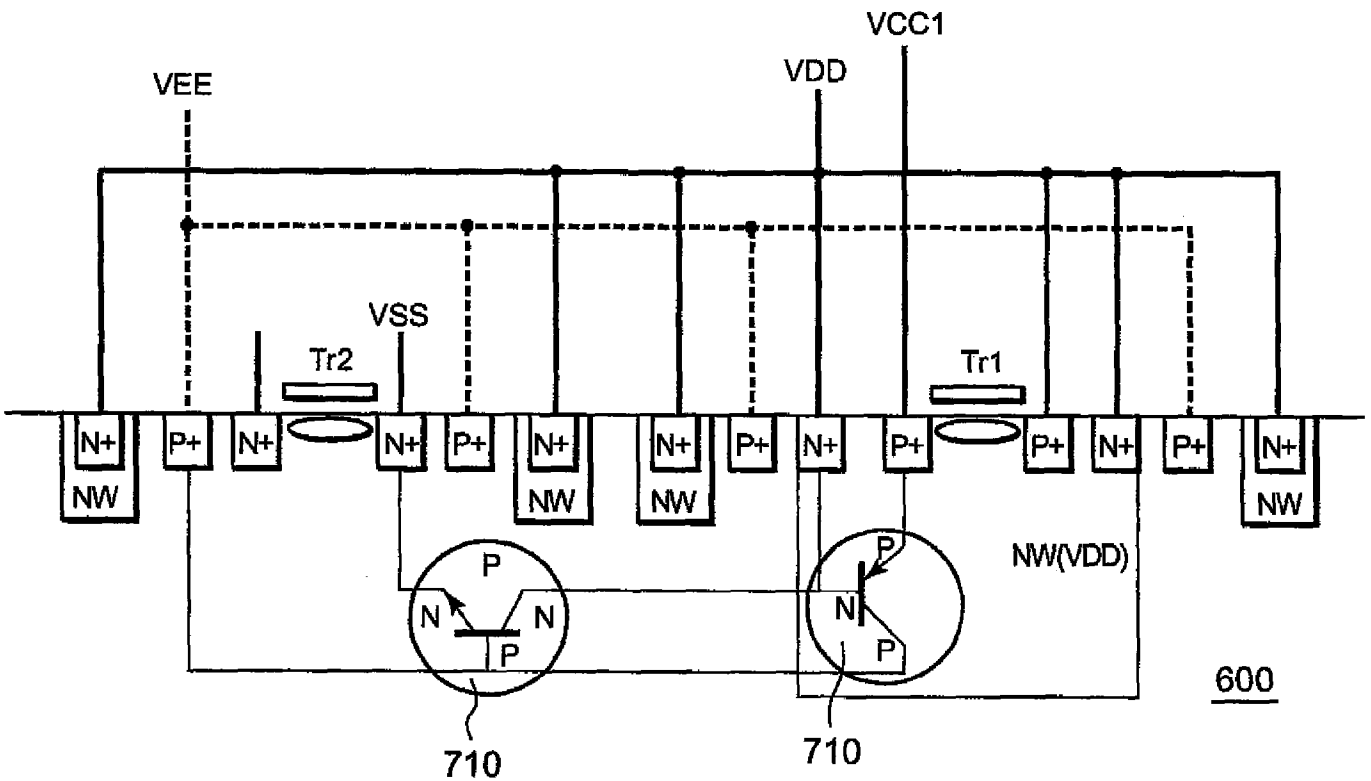
FIG. 2 PRIOR ART
FIG. 2 is a sectional view for describing the semiconductor substrate in which the parasitic bipolar transistors appear.
Figure 3:
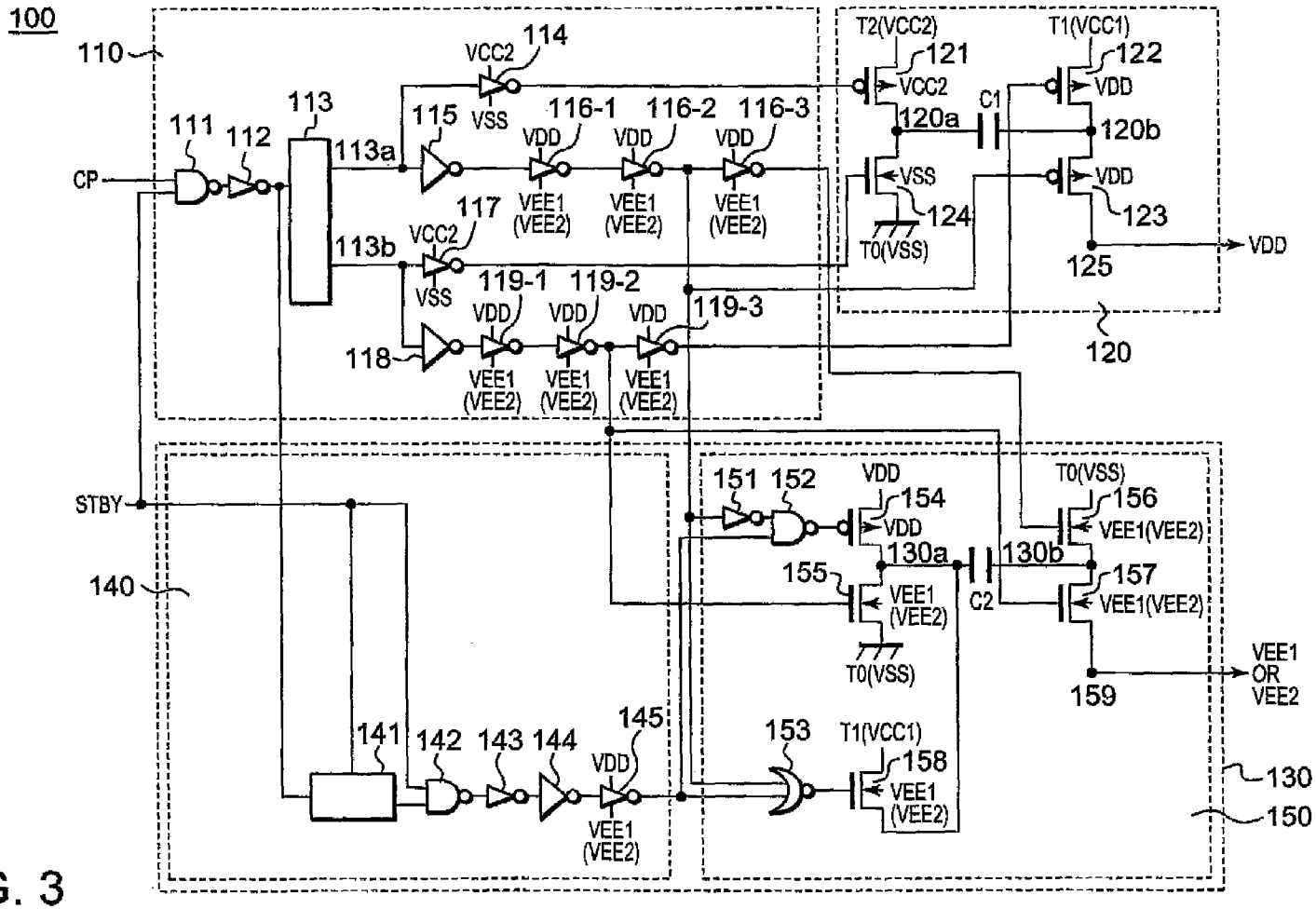
FIG. 3 is a schematic circuit diagram for describing a semiconductor integrated circuit according to a first preferred embodiment of the present invention.

FIG. 3 is a schematic circuit diagram for describing a semiconductor integrated circuit 100 according to a first preferred embodiment of the present invention. The semiconductor integrated circuit 100 includes a control circuit 110, a first voltage generating circuit 120 and a second voltage generating circuit 130. The semiconductor integrated circuit 100 is coupled to a first electrical source terminal T1 which receives a first external power supply voltage VCC1, a second electrical source terminal T2 which receives a second external power supply voltage VCC2 and a reference electrical source terminal T0 which receives a ground voltage VSS. In this example, the second external power supply voltage VCC2 is less than the first external power supply voltage VCC1. That is, the first external power supply voltage VCC1 is greater than the second external power supply voltage VCC2. For example, the first external power supply voltage VCC1 may be 12V and the second external power supply voltage VCC may be 3V. The first voltage generating circuit 120 generates a boosted voltage VDD based on the first external power supply voltage VCC1 and the second external power supply voltage VCC2. The boosted voltage VDD is greater than the first external power supply voltage VCC1. The second voltage generating circuit 130 generates a first converted output voltage VEE1 which is different than the boosted voltage VDD, based on the first external power supply voltage VCC1. Also, the second voltage generating circuit 130 generates a second converted output voltage VEE2 which is different than the boosted voltage VDD, based on the boosted voltage VDD. In this example, the first converted output voltage VEE1 and the second converted output voltage VEE2 are different from each other and are less than the ground voltage VSS.

The control circuit 110 includes an NAND circuit 111, an inverter 112 and a timing adjustment circuit 113 which are coupled in series. The NAND circuit 111 receives an external control signal CP and a standby signal STBY and then executes a logical operation between the external control signal CP and the standby signal STBY. The external control signal CP is used for boosting the first external power supply voltage VCC1. The inverter 112 inverts an output logical signal of the NAND circuit 112. The timing adjustment circuit 113 generates a first adjustment signal 113*a* and a second adjustment signal 113*b* in accordance with a signal which is output from the inverter 112, in order to suppress a consumption current from increasing in the first voltage generating circuit 120, when the external control signal CP transitions.

The control circuit 110 further includes a plurality of inverters 114, 116-1 through 116-3, 117, 119-1 through 119-3 and level shift circuits 115 and 118. The inverter 114 inverts the first adjustment signal 113*a* in accordance the second external power supply voltage VCC2 and the ground voltage VSS, and then provides an output signal to the first voltage generating circuit 120. The level shift circuit 115 and the inverters 116-1 through 116-3 are coupled in series. The level shift circuit 115 inverts the first adjustment signal 113*a*. An output signal of the level shift circuit 115 is provided to the first voltage generating circuit 120 through the inverters 116-1 and 116-2 and is also provided to the second voltage generating circuit 130 through the inverters 116-1 through 116-3. The inverters 116-1 through 116-3 operate in accordance with the boosted voltage VDD and the first converted output voltage VEE1 or the second converted output voltage VEE2. The inverter 117 inverts the second adjustment signal 113*b* in accordance the second external power supply voltage VCC2 and the ground voltage VSS, and then provides an output signal to the first voltage generating circuit 120. The level shift circuit 118 and the inverters 119-1 through 119-3 are coupled in series. The level shift circuit 118 inverts the second adjustment signal 113*b*. An output signal of the level shift circuit 118 is provided to the second voltage generating circuit 130 through the inverters 119-1 and 119-2 and is also provided to the first voltage generating circuit 120 through the inverters 119-1 through 119-3. The inverters 116-1 through 116-3 and 119-1 through 119-3 operate in accordance with the boosted voltage VDD and the first converted output voltage VEE1 or the second converted output voltage VEE2.

The first voltage generating circuit 120 includes a first boosting transistor 121, a second boosting transistor 122, a PMOS transistor 123 and an NMOS transistor 124. In this example, the first boosting transistor 121 and the second boosting transistor 122 are PMOS transistors. The first boosting transistor 121 includes a gate electrode which is coupled to the inverter 114 of the control circuit 110, a source electrode is coupled to the second electrical source terminal T2 and a drain electrode which is coupled to a first node 120*a*. The first boosting transistor 121 receives the second external power supply voltage VCC2 as its substrate voltage. The second boosting transistor 122 includes a gate electrode which is coupled to the inverter 119-3 of the control circuit 110, a source electrode which is coupled to the first electrical source terminal T1 and a drain electrode which is coupled to a second node 120*b*. The second boosting transistor 122 receives the boosted voltage VDD as its substrate voltage. The PMOS transistor 123 includes a gate electrode which is coupled to the inverter 116-2 of the control circuit 110, a source electrode which is coupled to an output terminal 125 of the first voltage generating circuit 120 and a drain electrode which is coupled to the second node 120*b*. The PMOS transistor 123 receives the boosted voltage VDD as its substrate voltage. The NMOS transistor 124 includes a gate electrode which is coupled to the inverter 117 of the control circuit 110, a source electrode which is coupled to the reference electrical source terminal T0 and a drain electrode which is coupled to the first node 120*a*. The NMOS transistor 124 receives the ground voltage VSS as its substrate voltage. The first voltage generating circuit 120 further includes a capacitor C1 which is coupled between the first node 120*a* and the second node 120*b*.

The second voltage generating circuit 130 includes an adjustment circuit 140 and a step-down circuit 150. The adjustment circuit 140 includes a counting circuit 141, an NAND circuit 142, an inverter 143, a level shift circuit 144 and an inverter 145 which are coupled in series. The counting circuit 141 receives the standby signal STBY and an output signal from the inverter 112 of the control circuit 110 in order to count the number of the transitions of the external control signal CP. In this example, the counting circuit 141 counts a number of rising transitions of the external control signal CP and provide an output signal to the NAND circuit 142 when the number exceeds a predetermined number. The NAND circuit 142 executes a logical operation between the standby signal STBY and an output signal from the counting circuit 141. The inverter 143 inverts an output signal from the NAND circuit 142. The level shift circuit 144 inverts an output signal from the inverter 143. The inverter 145 inverts an output signal from the level shift circuit 144. The inverter 145 operates in accordance with the boosted voltage VDD and the first converted output voltage VEE1 or the second converted output voltage VEE2. The step-down circuit 150 includes an inverter 151, an NAND circuit 152, a NOR circuit 153, a first converting transistor 158, a second converting transistor 154, a plurality of NMOS transistors 155 through 151, and a capacitor C2. In this example, the first converting transistor 158 is an NMOS transistor and the second converting transistor 154 is a PMOS transistor. The inverter 151 is coupled to the inverter 116-2 of the control circuit 110 so as to invert the output signal from the inverter 116-2. The NAND circuit 152 is coupled to the inverter 151 and the inverter 145 of the adjustment circuit 140 so as to execute a logical operation between output signals from the inverters 145 and 151. The NOR circuit 153 is coupled to the inverter 116-2 of the control circuit 110 and the inverter 145 of the adjustment circuit 140 so as to execute a logical operation between the output signals from the inverters 145 and 116-2. The first converting transistor 158 includes a gate electrode which is coupled to the NOR circuit 153, a source electrode which is coupled to the first electrical source terminal T1 and a drain electrode which is coupled to a third node 130*a*. The first converting transistor 158 receives the first converted output voltage VEE1 or the second converted output voltage VEE2 as its substrate voltage. The second converting transistor 154 includes a gate electrode which is coupled to the NAND circuit 152, a source electrode which is coupled to the output terminal 125 of the first voltage generating circuit 120 and a drain electrode which is coupled to the third node 130*a*. The second converting transistor 154 receives the boosted voltage VDD as its substrate voltage. That is, the first converting transistor 158 and the second converting transistor 154 are coupled in series between the output terminal 125 of the first voltage generating circuit 120 and the first electrical source terminal T1. Also, the source electrode of the first converting transistor 158 receives the first external power supply voltage VCC1, and the source electrode of the second converting transistor 154 receives the boosted voltage VDD. The NMOS transistor 155 includes a gate electrode which is coupled to the inverter 119-2 of the control circuit 110, a source electrode which is coupled to the reference electrical source terminal T0 and a drain electrode which is coupled to the third node 130*a*. The NMOS transistor 155 receives the first converted output voltage VEE1 or the second converted output voltage VEE2 as its substrate voltage. That is, the second converting transistor 154 and the NMOS transistor 155 are coupled in series between the output terminal 125 of the first voltage generating circuit 120 and the reference electrical source terminal T0. The NMOS transistor 156 includes a gate electrode which is coupled to the inverter 116-3 of the control circuit 110, a source electrode which is coupled to the reference electrical source terminal T0 and a drain electrode which is coupled to a fourth node 130*b*. The NMOS transistor 156 receives the first converted output voltage VEE1 or the second converted output voltage VEE2 as its substrate voltage. The NMOS transistor 157 includes a gate electrode which is coupled to the inverter 119-2 of the control circuit 110, a source electrode which is coupled to the fourth node and a drain electrode which is coupled to an output terminal 159 of the second voltage generating circuit 130. The NMOS transistor 157 receives the first converted output voltage VEE1 or the second converted output voltage VEE2 as its substrate voltage. The capacitor C2 includes one electrode which is coupled to the third node 130*a* and another electrode which is coupled to the fourth node 130*b*.

Figure 4:
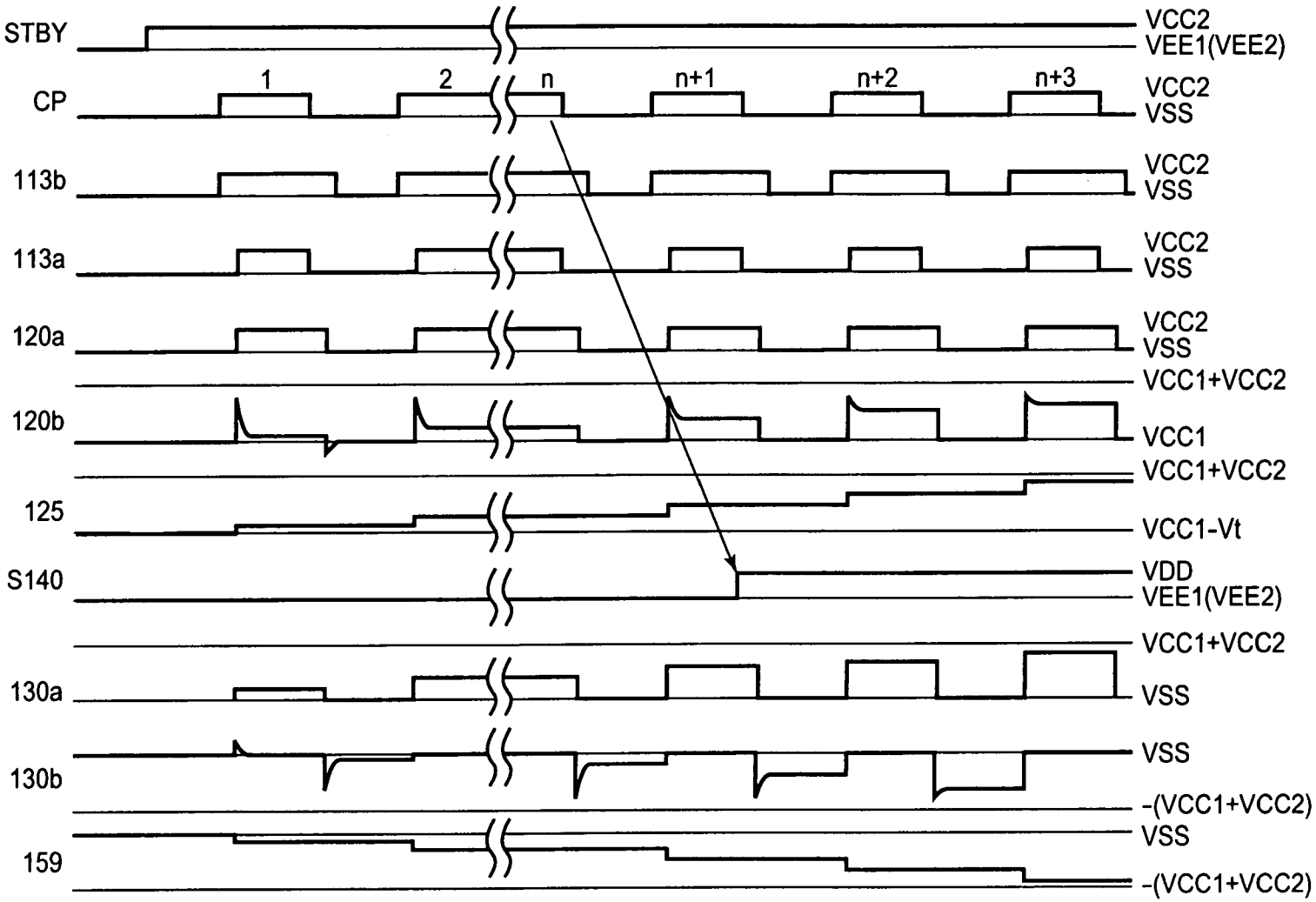
FIG. 4 is a signal waveform diagram for describing the operation of the semiconductor integrated circuit in FIG. 3.

The operation of the semiconductor integrated circuit 100 according to the first preferred embodiment of the present invention is described below. FIG. 4 is a signal waveform diagram for describing the operation of the semiconductor integrated circuit 100 in FIG. 3.

First of all, the generation of the boosting voltage VDD in the semiconductor integrated circuit 100 is described below. In the semiconductor integrated circuit 100, the external control signal CP can be input to the semiconductor integrated circuit 100 after the standby signal STBY is turned from a "Low" level (hereinafter referred to as the "L" level) to a "High" level (hereinafter referred to as the "H" level). Hereupon, when the standby signal STBY is kept at the "L" level, the semiconductor integrated circuit 100 is in a standby state. When the external control signal CP is turned from the "L" level to the "H" level, the timing adjustment circuit 113 receives a signal which is turned to the "H" level through the NAND circuit 111 and the inverter 112. Then, the second adjustment signal 113*b* is turned from the "L" level to the "H" level. That is, the inverter 117 provides the output signal which is turned to the "L" level. Therefore, the NMOS transistor 124 of the first voltage generating circuit 120 is turned OFF. Hereupon, when the NMOS transistor 124 is turned OFF, an electrical current does not pass through the NMOS transistor 124. Shortly after the transition of the second adjustment signal 113*b*, the first adjustment signal 113*a* is turned from the "L" level to the "H" level. That is, the inverter 114 provides the output signal which is turned to the "L" level. Therefore, the first boosting transistor (PMOS transistor) 121 of the first voltage generating circuit 120 is turned ON. Hereupon, when the first boosting transistor 121 is turned ON, an electrical current passes through the first boosting transistor 121. As described above, since the NMOS transistor 124 is turned OFF and the first boosting transistor 121 is turned ON, an electrical potential of the first node 120*a* is increased from the ground voltage VSS to the second external power supply voltage VCC2. Meanwhile, the second boosting transistor (PMOS transistor) 122 is turned ON and the PMOS transistor 123 is turned OFF, before the first and second adjustment signals 113*a* and 113*b* are turned to the "H" level. That is, an electrical potential of the second node 120*b* is kept at the first external power supply voltage VCC1 before the first and second adjustment signals 113*a* and 113*b* are turned to the "H" level as shown in FIG. 4. After the first and second adjustment signals 113*a* and 113*b* are turned to the "H" level, the second boosting transistor 122 is turned OFF and the PMOS transistor 123 is turned ON. Hereupon, since the second adjustment signal 113*b* is turned to the "H" level behind the transition of the first adjustment signal 113*a* toward the "H" level, the PMOS transistor 123 is turned ON after the second boosting transistor 122 is turned OFF. At this time, as described above, the electrical potential of the first node 120*a* is kept at the second external power supply voltage VCC2. Since the capacitor C1 is coupled between the first node 120*a* and the second node 120*b*, the electrical potential of the second node 120*b* begins to increase so as to become greater than the first external power supply voltage VCC1. That is, the electrical potential of the second node 120*b* begins to increase from the first external power supply voltage VCC1 toward a sum of the first external power supply voltage VCC1 and the second external power supply voltage VCC2. Also, since the PMOS transistor 123 is kept ON, an electrical potential of the output terminal 125 of the first voltage generating circuit 120 begins to increase from an initial voltage which is less than the first external power supply voltage VCC1 by a threshold voltage Vt of the PMOS transistor 123 toward a sum of the initial voltage and the second external power supply voltage VCC2.

Thereafter, the external control signal CP is turned from the "H" level to the "L" level, and then the first adjustment signal 113*a* is turned from the "H" level to the "L" level. That is, the inverter 114 provides the output signal which is turned to the "H" level. Therefore, the first boosting transistor 121 of the first voltage generating circuit 120 is turned OFF. Shortly after the transition of the first adjustment signal 113*a*, the second adjustment signal 113*b* is turned from the "H" level to the "L" level. That is, the inverter 117 provides the output signal which is turned to the "H" level. Therefore, the NMOS transistor 124 of the first voltage generating circuit 120 is turned ON. Accordingly, the electrical potential of the second node 120*b* temporarily becomes less than the first external power supply voltage VCC1 through the capacitor C1 as shown in FIG. 4. On the other hand, after the first and second adjustment signals 113*a* and 113*b* are turned to the "L" level, the second boosting transistor 122 is turned ON and the PMOS transistor 123 is turned OFF. Therefore, the electrical potential of the second node 120*b* returns to the first external power supply voltage VCC1 through the second boosting transistor 122. By repeating the operation as described above in the semiconductor integrated circuit 100, the electrical potential of the output terminal 125 of the first voltage generating circuit 120 can be increased substantially to the sum of the first external power supply voltage VCC1 and the second external power supply voltage VCC2.

Next, the generation of the first converted output voltage VEE1 or the second converted output voltage VEE2 in the semiconductor integrated circuit 100 is described below. When the standby signal STBY is turned from the "L" level to the "H" level, the external control signal CP can be input to the semiconductor integrated circuit 100 and the counting circuit 141 of the adjustment circuit 140 can operate in order to count a number of transitions of the external control signal CP. Before the counted number of the counting circuit 141 does not exceed the predetermined number, the counting circuit 141 provides the output signal which is kept at the "L" level to the NAND circuit 142. Since the standby signal STBY is kept at the "H" level at this time, the NOR circuit 153 of the step-down circuit 150 receives an adjustment signal S140 which is kept at the "L" level through the inverter 143, the level shift circuit 144 and the inverter 145.

When the external control signal CP is turned from the "L" level to the "H" level, the inverter 116-2 of the control circuit 110 provides the signal which is kept at the "L" level to the NOR circuit 153. Therefore, the gate electrode of the first converting transistor 158 receives a signal which is turned to the "H" level from the NOR circuit 153. That is, the first converting transistor 158 is turned ON. Also, since the inverter 116-2 of the control circuit 110 provides the signal which is kept at the "L" level to the inverter 151, the NAND circuit 152 receives a signal which is turned to the "H" level from the inverter 151. Meanwhile, the NAND circuit 152 receives the adjustment signal S140 from the inverter 145 of the adjustment circuit 140. Therefore, the gate electrode of the second converting transistor 154 receives a signal which is turned to the "H" level from the NAND circuit 152. That is, the second converting transistor 154 is turned OFF. Furthermore, at this time, the gate electrode of the NMOS transistor 155 receives a signal which is turned to the "L" level from the inverter 119-2 of the control circuit 110. That is, the NMOS transistor 155 is turned OFF. Accordingly, an electrical potential of the third node 130*a* is increased to the first external power supply voltage VCC1 from which a threshold voltage Vt of the first converting transistor 158 is subtracted. That is, the capacitor C2 is charged by the first external power supply voltage VCC1. As a result, an electrical potential of the fourth node 130*b* begins to increase through the capacitor C2, toward the first external power supply voltage VCC1 from which the threshold voltage Vt of the first converting transistor 158 is subtracted. However, on the other hand, when the first adjustment signal 113*a* is turned from the "L" level to the "H" level, the gate electrode of the NMOS transistor 156 receives a signal which is turned to the "H" level from the inverter 116-3 of the control circuit 110. Likewise, when the second adjustment signal 113*b* is turned from the "L" level to the "H" level, the gate electrode of the NMOS transistor 157 receives a signal which is turned to the "L" level from the inverter 119-2 of the control circuit 110. That is, the NMOS transistor 156 is turned ON and the NMOS transistor 157 is turned OFF. Accordingly, the electrical potential of the fourth node 130*b* is kept at the ground voltage VSS.

Then, the external control signal CP is turned from the "H" level to the "L" level, and then the first adjustment signal 113*a* is turned from the "H" level to the "L" level. At this time, the NOR circuit 153 of the step-down circuit 150 receives a signal which is turned to the "H" level from the inverter 116-2 of the control circuit 110. Therefore, the gate electrode of the first converting transistor 158 receives a signal which is turned to the "L" level from the NOR circuit 153. That is, the first converting transistor 158 is turned OFF. Shortly after the transition of the first adjustment signal 113*a*, the second adjustment signal 113*b* is turned from the "H" level to the "L" level. Therefore, the gate electrode of the NMOS 155 receives a signal which is turned to the "H" level from the inverter 119-2 of the control circuit 110. That is, the NMOS transistor 155 is turned ON. As a result, the electrical potential of the third node 130*a* is turned, from the first external power supply voltage VCC1 from which the threshold voltage Vt of the first converting transistor 158 is subtracted, toward the ground voltage VSS as shown in FIG. 4. In accordance with the transition of the electrical potential of the third node 130*a*, the electrical potential of the fourth node 130*b* begins to be decreased through the capacitor C2, toward a sum of the ground voltage VSS and the threshold voltage Vt of the first converting transistor 158, from which the first external power supply voltage VCC1 is subtracted. On the other hand, when the first adjustment signal 113*a* is turned from the "H" level to the "L" level, the gate electrode of the NMOS transistor 156 receives a signal which is turned to the "L" level from the inverter 116-3 of the control circuit 110. Likewise, when the second adjustment signal 113*b* is turned from the "H" level to the "L" level, the gate electrode of the NMOS transistor 157 receives a signal which is turned to the "H" level from the inverter 119-2 of the control circuit 110. That is, almost as soon as the electrical potential of the fourth node 130*b* begins to be decreased as described above, the NMOS transistor 156 is turned OFF and the NMOS transistor 157 is turned ON. As a result, the electrical potential of the fourth node 130*b* which becomes a little less than the ground voltage VSS is transferred to the output terminal 159 of the second voltage generating circuit 130 through the NMOS transistor 157. That is, the first converted output voltage VEE1 is generated from the output terminal 159, based on the first external power supply voltage VCC1. By repeating the operation as described above in the semiconductor integrated circuit 100, the electrical potential of the output terminal 159 of the second voltage generating circuit 130 may be decreased as shown in FIG. 4.

Thereafter, when the counted number of the counting circuit 141 exceeds the predetermined number, the counting circuit 141 generates the output signal which is turned from the "L" level to the "H" level for the NAND circuit 142. Since the standby signal STBY is kept at the "H" level at this time, the adjustment signal S140 is turned from the "L" level to the "H" level. At this time, the gate electrode of the first converting transistor 158 receives the signal which is turned to the "L" level from the NOR circuit 153. That is, the first converting transistor 158 is turned OFF. Also, though the gate electrode of the second converting transistor 154 receives the signal which is turned to the "H" level from the NAND circuit 152, the boosted voltage VDD is so great that difference in potential between the gate electrode and the source electrode of the second converting transistor 154 exceeds the threshold voltage Vt of the second converting transistor 154. That is, the second converting transistor 154 is turned ON. As a result, the electrical potential of the third node 130*a* is changed based on the boosted voltage VDD which is output from the first voltage generating circuit 120. That is, the second converted output voltage VEE2 is generated from the output terminal 159, based on the boosted voltage VDD. By further repeating the operation as described above in the semiconductor integrated circuit 100, the electrical potential of the output terminal 159 of the second voltage generating circuit 130 may be decreased substantially until an electrical potential which is less than the ground voltage VSS by the boosted voltage VDD.

According to the first preferred embodiment, the second voltage generating circuit is coupled to the first electrical source terminal and the first voltage generating circuit to generate the converted voltage which is different than the boosted voltage. That is, the second voltage generating circuit generates a first converted output voltage based on the first external power supply voltage, and thereafter generates a second converted output voltage based on the boosted voltage. Therefore, the parasitic bipolar transistors may be suppressed from appearing in the semiconductor integrated circuit, even if the electrical charge in the boosted voltage is consumed to be decreased. As a result, the latch-up phenomenon may be suppressed from appearing in the semiconductor integrated circuit. Also, since it is not necessary that the diode is coupled to the output terminal of the first voltage generating circuit, the costs and processes to manufacture the semiconductor integrated circuit may be decreased.

Figure 5:
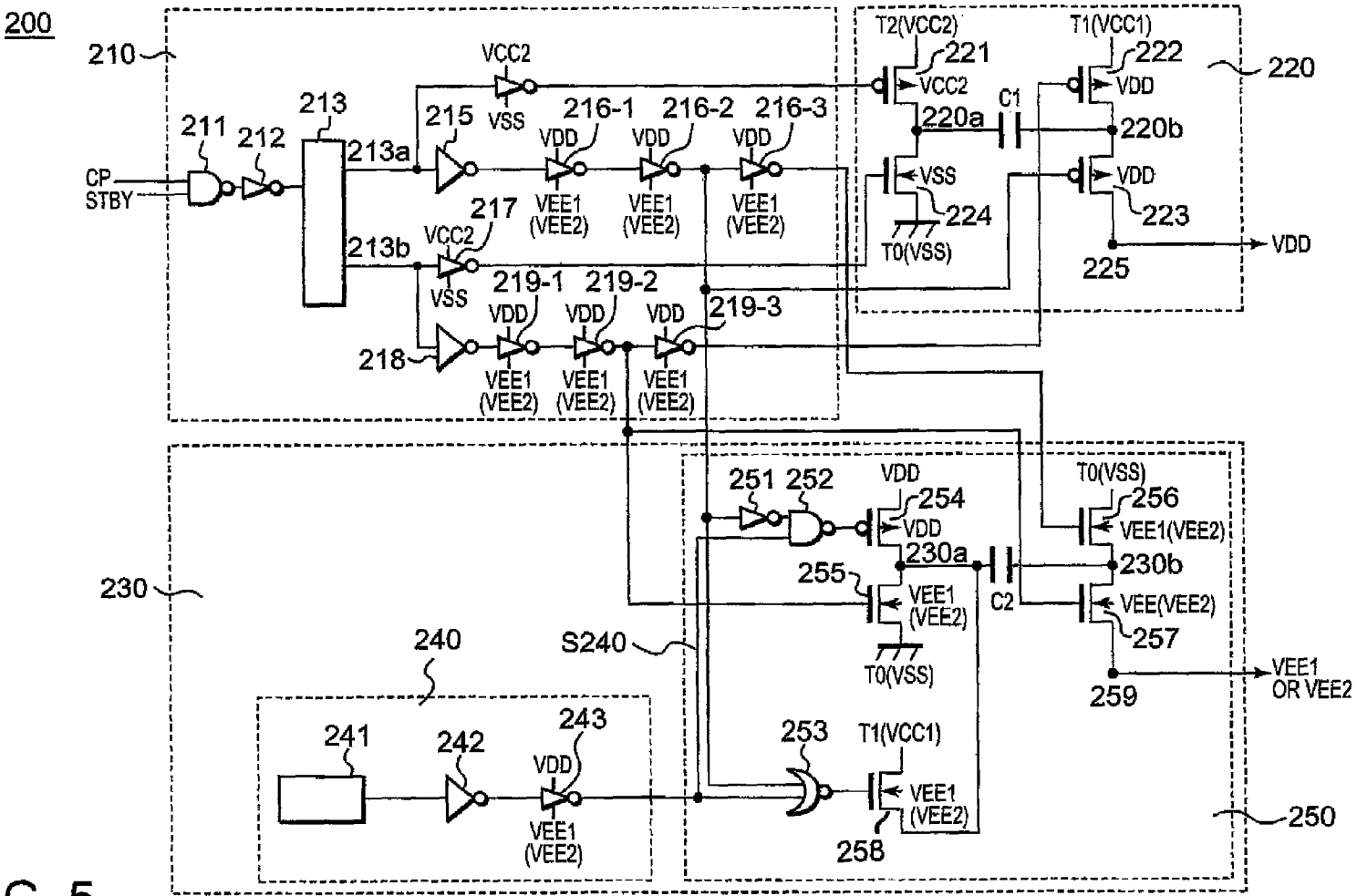
FIG. 5 is a schematic circuit diagram for describing a semiconductor integrated circuit according to a second preferred embodiment of the present invention.

FIG. 5 is a schematic circuit diagram for describing a semiconductor integrated circuit 200 according to a second preferred embodiment of the present invention. The semiconductor integrated circuit 200 according to the second preferred embodiment includes an adjustment circuit 240 which is different than the adjustment circuit 140 according to the first preferred embodiment. The other configurations of the semiconductor integrated circuit 200 according to the second preferred embodiment are similar to those according to the first preferred embodiment.

The semiconductor integrated circuit 200 includes a control circuit 210, a first voltage generating circuit 220 and a second voltage generating circuit 230. The first voltage generating circuit 220 generates the boosted voltage VDD based on the first external power supply voltage VCC1 and the second external power supply voltage VCC2. The second voltage generating circuit 230 generates the first converted output voltage VEE1 based on the first external power supply voltage VCC1 and generates the second converted output voltage VEE2 based on the boosted voltage VDD, as well as the first and second voltage generating circuits 120 and 130 according to the first preferred embodiment.

The second voltage generating circuit 230 includes the adjustment circuit 240 and a step-down circuit 250. The step-down circuit 250 is similar to the step-down circuit 150 according to the first preferred embodiment. The adjustment circuit 240 includes a monitoring circuit 241, a level shift circuit 242 and an inverter 243 which are coupled in series. The monitoring circuit 241 is coupled to the output terminal 225 of the first voltage generating circuit 220, in order to monitor changes in the boosted voltage VDD and control the first converting transistor 258 and the second converting transistor 254 of the step-down circuit 250 in accordance with the changes in the boosted voltage VDD. The level shift circuit 242 inverts an output signal which is output from the monitoring circuit 241. The inverter 243 generates an adjustment signal S240 shown in FIG. 7. based on a signal which is output from the level shift circuit 242, for the NAND circuit 252 and the NOR circuit 253 of the step-down circuit 250.

Figure 6:
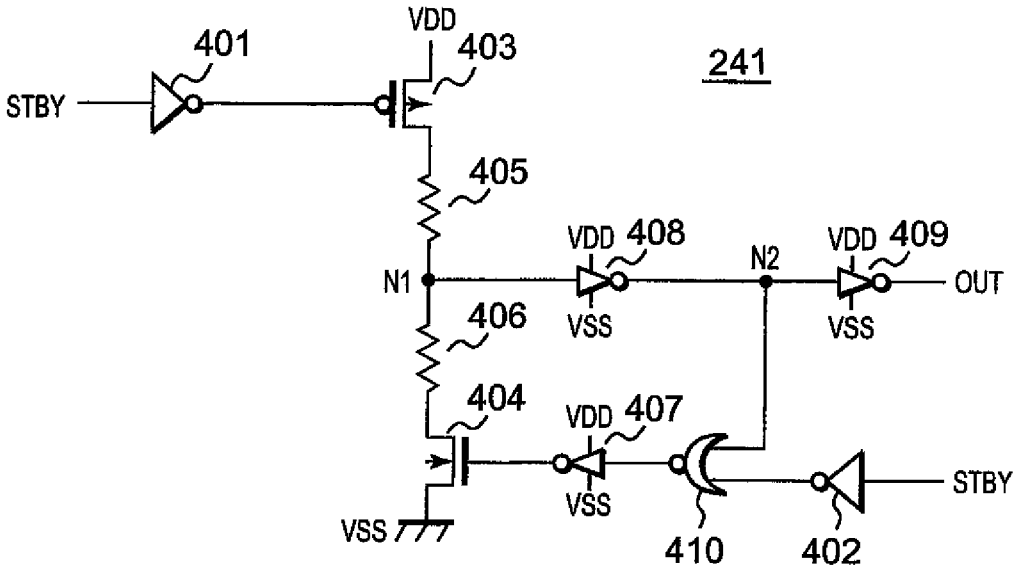
FIG. 6 is a schematic circuit diagram for describing a monitoring circuit according to the second preferred embodiment of the present invention.

FIG. 6 is a schematic circuit diagram for describing the monitoring circuit 241 according to the second preferred embodiment of the present invention. The monitoring circuit 241 includes level shift circuits 401 and 402, a PMOS transistor 403 which is a controlling MOS transistor, an NMOS transistor 404, resistance elements 405 and 406, inverters 407 through 409 and a NOR circuit 410. The level shift circuit 401 and 402 change a level of the standby signal STBY to invert the standby signal STBY. The PMOS transistor 403 includes a gate electrode which is coupled to the level shift circuit 401, a source electrode which is coupled to output terminal 225 of the first voltage generating circuit 220 and a drain electrode which is coupled to the resistance element 405. The PMOS 403 and the resistance element 405 are coupled between the output terminal 225 of the first voltage generating circuit 220 and a first intermediate node N1. The NMOS transistor 404 includes a gate electrode which is coupled to the inverter 407, a source electrode which is coupled to the reference electrical source terminal T0 and a drain electrode which is coupled to the resistance element 406. The resistance element 406 and the NMOS transistor 404 are coupled between the first intermediate node N1 and the reference electrical source terminal T0. The inverter 407 is coupled between the gate electrode of the NMOS transistor 404 and the NOR circuit 410. The inverter 407 inverts a signal which is output from the NOR circuit 410. The inverter 408 is coupled between the first intermediate node N1 and a second intermediate node N2. The inverter 408 generates an output signal based on an electrical potential of the first intermediate node N1, for the inverter 409 and the NOR circuit 410. The inverter 409 is coupled between the second intermediate node N2 and an output terminal of the monitoring circuit 241. The inverter 409 inverts the output signal from the inverter 408. The NOR circuit 410 executes a logical operation between the output signals which are output from the inverter 408 and the level shift circuit 402.

Figure 7:
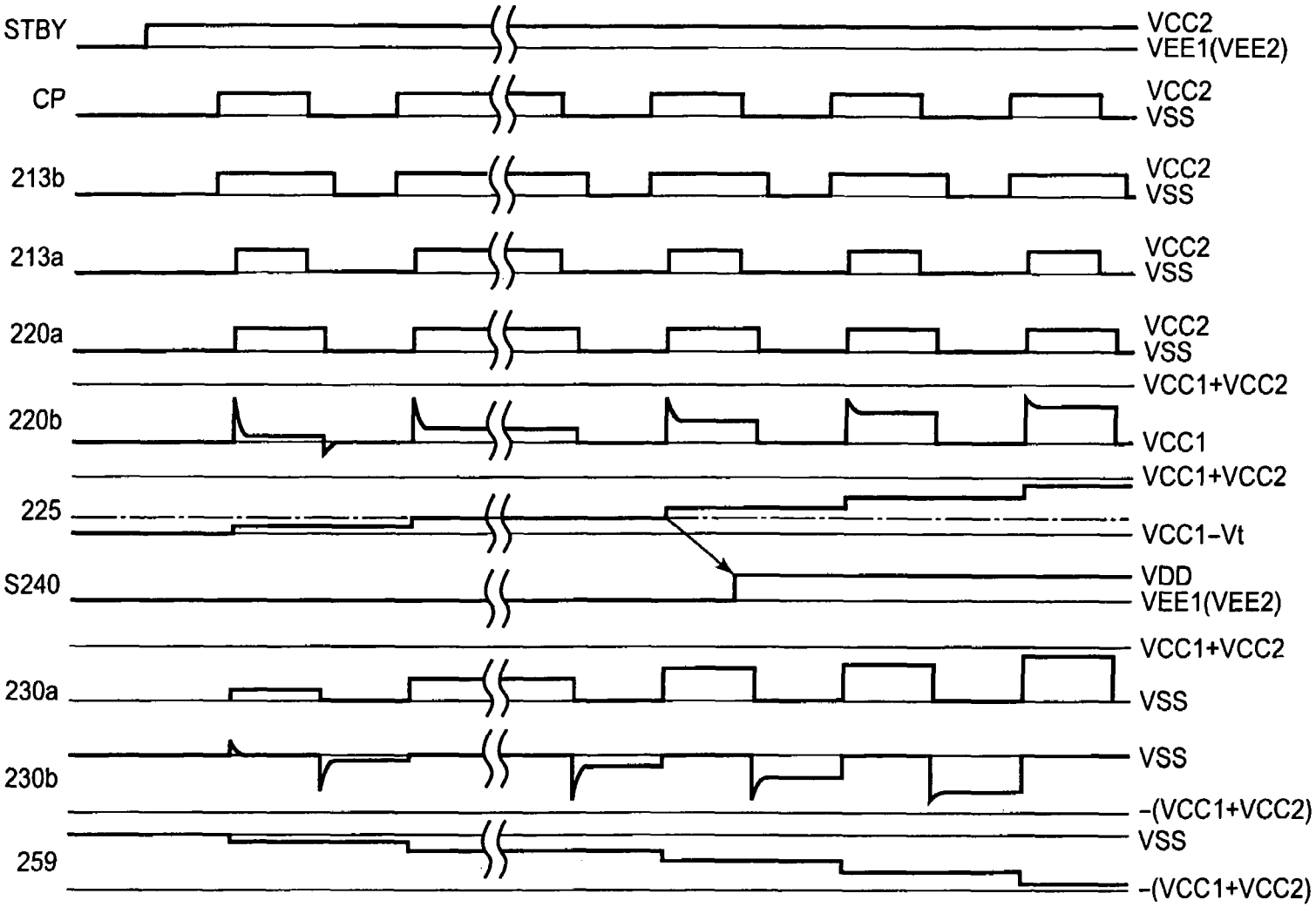
FIG. 7 is a signal waveform diagram for describing the operation of the semiconductor integrated circuit in FIG. 5.

The operation of the semiconductor integrated circuit 200 according to the second preferred embodiment of the present invention is described below. FIG. 7 is a signal waveform diagram for describing the operation of the semiconductor integrated circuit 200 in FIG. 5. In addition, the generating method of the boosting voltage VDD in the semiconductor integrated circuit 200 is the same as that in the semiconductor integrated circuit 100 according to the first preferred embodiment. The generating method of the first converted output voltage VEE1 and the second converted output voltage VEE2 in the semiconductor integrated circuit 200 is described below.

While the boosted voltage VDD is increased by the first voltage generating circuit 220, the change in the boosted voltage VDD is monitored by the monitoring circuit 241. The monitoring circuit 241 provides the output signal which is kept at the "L" level to the level shift circuit 242 before the boosted voltage VDD does not exceed a predetermined level. Meanwhile, the monitoring circuit 241 provides the output signal which is kept at the "H" level to the level shift circuit 242 after the boosted voltage VDD exceeds the predetermined level. When the standby signal STBY is turned from the "L" level to the "H" level and the external control signal CP is turned from the "L" level to the "H" level, the inverter 215-2 of the control circuit 210 provides the signal which is kept at the "L" level to the NOR circuit 253 of the step-down circuit 250. On the other hand, as shown in FIG. 6, when the standby signal STRY is turned from the "L" level, the PMOS transistor 403 receives a signal which is turned to the "L" level from the inverter 401. However, the boosted voltage VDD is not great so as to turn ON the PMOS transistor 403. Therefore, an electrical potential of the first intermediate node N1 is kept at the "U" level so that the inverter 409 generates a signal which is kept at the "L" level. Also, since an electrical potential of the second intermediate node N2 is kept at the "H" level, the NMOS transistor 404 is turned ON so that the first intermediate node N1 is kept at the "L " level. That is, the monitoring circuit 241 provides the output signal which is kept at the "L" level as the adjustment signal S240 before the boosted voltage VDD exceeds the predetermined level. Therefore, the gate electrode of the first converting transistor 258 receives a signal which is turned to the "H" level from the NOR circuit 253. That is, the first converting transistor 258 is turned ON. Also, since the inverter 216-2 of the control circuit 210 provides the signal which is kept at the "L" level to the inverter 251, the NAND circuit 252 receives a signal which is turned to the "H" level from the inverter 251. Meanwhile, the NAND circuit 252 receives the adjustment signal S240 from the inverter 243 of the adjustment circuit 240. Therefore, the gate electrode of the second converting transistor 254 receives a signal which is turned to the "H" level from the NAND circuit 252. That is, the second converting transistor 254 is turned OFF. Furthermore, at this time, the gate electrode of the NMOS transistor 255 receives a signal which is turned to the "L" level from the inverter 219-2 of the control circuit 210. That is, the NMOS transistor 255 is turned OFF. Accordingly, an electrical potential of the third node 230*a* is increased to the first external power supply voltage VCCI from which a threshold voltage Vt of the first converting transistor 258 is subtracted. That is, the capacitor C2 is charged by the first external power supply voltage VCC1. As a result, an electrical potential of the fourth node 230*b* begins to increase through the capacitor C2, toward the first external power supply voltage VCC1 from which the threshold voltage Vt of the first converting transistor 258 is subtracted. However, on the other hand, when the first adjustment signal 213*a* is turned from the "L" level to the "H" level, the gate electrode of the NMOS transistor 256 receives a signal which is turned to the "H" level from the inverter 216-3 of the control circuit 210. Likewise, when the second adjustment signal 213*b* is turned from the "L" level to the "H" level, the gate electrode of the NMOS transistor 251 receives a signal which is turned to the "L" level from the inverter 219-2 of the control circuit 210. That is, the NMOS transistor 256 is turned ON and the NMOS transistor 257 is turned OFF. Accordingly, the electrical potential of the fourth node 230*b* is kept at the ground voltage VSS as shown in FIG. 7.

Then, the external control signal CP is turned from the "H" level to the "L" level, and then the first adjustment signal 213*a* is turned from the "H" level to the "L" level. At this time, the NOR circuit 253 of the step-down circuit 250 receives a signal which is turned to the "H" level from the inverter 216-2 of the control circuit 210. Therefore, the gate electrode of the first converting transistor 258 receives a signal which is turned to the "L" level from the NOR circuit 253. That is, the first converting transistor 258 is turned OFF. Shortly after the transition of the first adjustment signal 213*a*, the second adjustment signal 213*b* is turned from the "H" level to the "L" level. Therefore, the gate electrode of the NMOS 255 receives a signal which is turned to the "H" level from the inverter 219-2 of the control circuit 210. That is, the NMOS transistor 255 is turned ON. As a result, the electrical potential of the third node 230*a* is turned, from the first external power supply voltage VCC1 from which the threshold voltage Vt of the first converting transistor 258 is subtracted, toward the ground voltage VSS as shown in FIG. 7. In accordance with the transition of the electrical potential of the third node 230*a*, the electrical potential of the fourth node 230*b* begins to be decreased through the capacitor C2, toward a sum of the ground voltage VSS and the threshold voltage Vt of the first converting transistor 258, from which the first external power supply voltage VCC1 is subtracted. On the other hand, when the first adjustment signal 213*a* is turned from the "H" level to the "L" level, the gate electrode of the NMOS transistor 256 receives a signal which is turned to the "L" level from the inverter 216-3 of the control circuit 210. Likewise, when the second adjustment signal 213*b* is turned from the "H" level to the "L" level, the gate electrode of the NMOS transistor 257 receives a signal which is turned to the "H" level from the inverter 219-2 of the control circuit 210. That is, almost as soon as the electrical potential of the fourth node 230*b* begins to be decreased as described above, the NMOS transistor 256 is turned OFF and the NMOS transistor 257 is turned ON. As a result, the electrical potential of the fourth node 230*b* which becomes a little less than the ground voltage VSS is transferred to the output terminal 259 of the second voltage generating circuit 230 through the NMOS transistor 257. That is, the first converted output voltage VEE1 is generated from the output terminal 259, based on the first external power supply voltage VCC1. By repeating the operation as described above in the semiconductor integrated circuit 200, the electrical potential of the output terminal 259 of the second voltage generating circuit 230 may be decreased as shown in FIG. 7.

Thereafter, after the boosted voltage VDD exceeds the predetermined level, the PMOS transistor 403 is turned ON. Then, the electrical potential of the first intermediate node N1 is turned to the "H" level, and the electrical potential of the second intermediate node N2 is turned to the "L" level. Therefore, the NOR circuit 410 generates the signal which is turned to the "H" level so that the NMOS transistor 404 is turned OFF. Accordingly, the inverter 409 generates a signal which is kept at the "H" level. That is, the monitoring circuit 241 provides the output signal which is kept at the "H" level as the adjustment signal S240, to the level shift circuit 242, after the boosted voltage VDD exceeds the predetermined level. At this time, the gate electrode of the first converting transistor 258 receives the signal which is turned to the "L" level from the NOR circuit 253. That is, the first converting transistor 258 is turned OFF. Also, though the gate electrode of the second converting transistor 254 receives the signal which is turned to the "H" level from the NAND circuit 252, the boosted voltage VDD is so great that difference in potential between the gate electrode and the source electrode of the second converting transistor 254 exceeds the threshold voltage Vt of the second converting transistor 254. That is, the second converting transistor 254 is turned ON. As a result, the electrical potential of the third node 230*a* is changed based on the boosted voltage VDD which is output from the first voltage generating circuit 220. That is, the second converted output voltage VEE2 is generated from the output terminal 259, based on the boosted voltage VDD. By further repeating the operation as described above in the semiconductor integrated circuit 200, the electrical potential of the output terminal 259 of the second voltage generating circuit 230 may be decreased substantially until an electrical potential which is less than the ground voltage VSS by the boosted voltage VDD.

According to the second preferred embodiment, the second voltage generating circuit is coupled to the first electrical source terminal and the first voltage generating circuit to generate the converted voltage which is different than the boosted voltage. That is, the second voltage generating circuit generates the first converted output voltage based on the first external power supply voltage, and thereafter generates the second converted output voltage based on the boosted voltage. Therefore, the parasitic bipolar transistors may be suppressed from appearing in the semiconductor integrated circuit, even if the electrical charge in the boosted voltage is consumed to be decreased. As a result, the latch-up phenomenon may be suppressed from appearing in the semiconductor integrated circuit. Also, since it is not necessary that the diode is coupled to the output terminal of the first voltage generating circuit, the costs and processes to manufacture the semiconductor integrated circuit may be decreased.

What is claimed is:

1. A semiconductor integrated circuit, comprising:

a first electrical source terminal which receives a first external power supply voltage;

a first voltage generating circuit which is coupled to the first electrical source terminal and which generates a boosted voltage based on the first external power supply voltage, the boosted voltage being greater than the first external power supply voltage; and a second voltage generating circuit which is coupled to the first electrical source terminal to receive the first external power supply voltage and is coupled to the first voltage generating circuit to receive the boosted voltage, wherein the second voltage generating circuit generates a first converted output voltage based on the first external power supply voltage, and then generates a second converted output voltage based on the boosted voltage after the first converted output voltage has been generated based on the first external power supply voltage, and wherein both of the first and second converted output voltages are less than the boosted voltage and gradually decrease, and wherein the second converted output voltage is less than the first converted output voltage.

2. The semiconductor integrated circuit according to claim 1, further comprising:

a second electrical source terminal which receives a second external power supply voltage that is less than the first external power supply voltage; and a reference electrical source terminal which receives a ground voltage, wherein the first voltage generating circuit is coupled to the second electrical source terminal and the second voltage generating circuit is coupled to the reference electrical source terminal, wherein the boosted voltage is generated based on the first external power supply voltage and the second external power supply voltage, and wherein the first converted output voltage is generated based on the first external power supply voltage and the ground voltage and the second converted output voltage is generated based on the boosted voltage and the ground voltage.

3. The semiconductor integrated circuit according to claim 2, wherein the first voltage generating circuit comprises:

an output terminal from which the boosted voltage is output;

a capacitor having one electrode coupled to the second electrical source terminal and having another electrode coupled to the output terminal of the first voltage generating circuit and the first electrical source terminal;

a first boosting transistor coupled between the second electrical source terminal and the one electrode of the capacitor; and a second boosting transistor coupled between the first electrical source terminal and the another electrode of the capacitor.

4. The semiconductor integrated circuit according to claim 2, wherein the first and second converted output voltages are less than the ground voltage.

5. The semiconductor integrated circuit according to claim 1, wherein the first voltage generating circuit comprises an output terminal from which the boosted voltage is output and the second voltage generating circuit comprises an output terminal from which the first and second converted output voltages are output, and wherein the second voltage generating circuit further comprises:

a capacitor having one electrode coupled to the output terminal of the first voltage generating circuit and another electrode coupled to the output terminal of the second voltage generating circuit;

a first converting transistor coupled between the first electrical source terminal and the one electrode of the capacitor; and a second converting transistor coupled between the output terminal of the first voltage generating circuit and the one electrode of the capacitor, wherein the first converting transistor is turned ON when the second converting transistor is turned OFF, and the second converting transistor is turned ON when the first converting transistor is turned OFF.

6. The semiconductor integrated circuit according to claim 5, wherein the first converted output voltage is generated through the capacitor and the first converting transistor, and the second converted output voltage is generated through the capacitor and the second converting transistor.

7. The semiconductor integrated circuit according to claim 5, wherein the first and second voltage generating circuits are controlled by an external control signal, and wherein the second voltage generating circuit further comprises:

a counting circuit coupled to the second voltage generating circuit, wherein the counting circuit counts a number of transitions of the external control signal and controls the first converting transistor and the second converting transistor in accordance with the counted number of transitions of the external control signal.

8. The semiconductor integrated circuit according to claim 7, wherein the counting circuit memorizes a predetermined number of transitions of the external control signal, wherein the counting circuit turns ON the first converting transistor and turns OFF the second converting transistor before the counted number exceeds the predetermined number, and wherein the counting circuit turns ON the second converting transistor and turns OFF the first converting transistor after the counted number exceeds the predetermined number.

9. The semiconductor integrated circuit according to claim 7, wherein the counting circuit is controlled by a standby signal.

10. The semiconductor integrated circuit according to claim 5, wherein the second voltage generating circuit comprises a monitoring circuit coupled to the output terminal of the first voltage generating circuit, wherein the monitoring circuit monitors a change in the boosted voltage and controls the first converting transistor and the second converting transistor in accordance with the change of the boosted voltage.

11. The semiconductor integrated circuit according to claim 10, wherein the monitoring circuit comprises a controlling MOS transistor coupled to the output terminal of the first voltage generating circuit, the controlling MOS transistor being turned ON based on the boosted voltage, and wherein the first converting transistor is turned ON before the controlling MOS transistor of the monitoring circuit is turned ON and the second converting transistor is turned ON after the controlling MOS transistor of the monitoring circuit is turned ON.

12. The semiconductor integrated circuit according to claim 11, wherein the first converted output voltage is generated while the controlling MOS transistor of the monitoring circuit is turned OFF and the second converted output voltage is generated after the controlling MOS transistor of the monitoring circuit is turned ON.

13. The semiconductor integrated circuit according to claim 11, wherein the controlling MOS transistor of the monitoring circuit is controlled by a standby signal.

14. A generating method of different voltages, comprising:

generating a boosted voltage based on a first external power supply voltage, the boosted voltage being greater than the first external power supply voltage;

generating a first converted output voltage based on the first external power supply voltage, wherein the first converted output voltage is different than the boosted voltage; and generating a second converted output voltage based on the boosted voltage after the first converted output voltage has been generated based on the first external power supply voltage, wherein both of the first and second converted output voltages are less the boosted voltage and gradually decrease, and wherein the second converted output voltage is less than the first converted output voltage.

15. The generating method according to claim 14, wherein the boosted voltage is generated based on the first external power supply voltage and a second external power supply voltage which is less than the first external power supply voltage, and wherein the first converted output voltage is generated based on the first external power supply voltage and a ground voltage, and wherein the second converted output voltage is generated based on the boosted voltage and the ground voltage.

16. The generating method according to claim 15, wherein the first and second converted output voltages are less than the ground voltage.

17. The generating method according to claim 14, wherein the first converted output voltage is generated and the second converted output voltage is not generated during a predetermined time, and the first converted output voltage is not generated and the second converted output voltage is generated after a lapse of the predetermined time.

18. The generating method according to claim 17, further comprising:

counting a number of transitions of an external control signal to measure the predetermined time, wherein the external control signal controls the generation of the first or second converted output voltage.

19. The generating method according to claim 17, further comprising:

monitoring a change in the boosted voltage to measure the predetermined time.

* * * * *